US005911751A

United States Patent [19]

Kim

[11] Patent Number: 5,911,751

[45] Date of Patent: Jun. 15, 1999

[54] INTERGRATED AIR CONDITIONER

[75] Inventor: Jae-soon Kim, Suwon, Rep. of Korea

[73] Assignee: Samsung Electronics Co., Ltd., Suwon, Rep. of Korea

[21] Appl. No.: 09/008,573

[22] Filed: Jan. 16, 1998

[30] Foreign Application Priority Data

Feb. 11, 1997 [KR] Rep. of Korea ..... 97-4009

[51] Int. Cl.[6] ..... F25D 17/04

[52] U.S. Cl. ..... 62/407; 62/262; 454/190

[58] Field of Search ..... 62/262, 404, 407; 454/190, 188; 415/208.1, 211.2, 206, 914, 919, 211.1

[56] References Cited

U.S. PATENT DOCUMENTS 3,211,077 10/1965 Kramer, Jr. ..... 454/190

5,775,123 7/1998 Wakayama et al. ..... 62/407

FOREIGN PATENT DOCUMENTS 5-40732 6/1993 Japan .

*Primary Examiner*—Henry Bennett

*Assistant Examiner*—Melvin Jones

*Attorney, Agent, or Firm*—Burns, Doane, Swecker & Mathis, L.L.P.

[57] ABSTRACT

An integrated air conditioner which can control a flow rate of a chilled air blown by a blowing fan to improve heat-exchange capacity of an evaporator is disclosed. The chilled air generated by the evaporator is flowed through a chilled air guide duct by the blowing fan, and the flow velocity and the flow rate of the chilled air are controlled by a flow rate control section formed in the chilled air guide duct. The load of a motor which drives the blowing fan is decreased by the flow rate control section, and thus heat-exchange capacity of the evaporator is improved. The air conditioner is simple in structure and is facilitated to use, and the energy consumption efficiency is improved.

4 Claims, 3 Drawing Sheets

INTERGRATED AIR CONDITIONER

BACKGROUND OF THE INVENTION

1. Field of the Invention

The present invention relates to an integrated air conditioner, and more particularly to an air conditioner which decreases a flow rate of a chilled air to improve product quality thereof.

2. Description of the Prior Art

FIG. 1 shows a conventional integrated air conditioner 10. As shown in FIG. 1, the conventional air conditioner 10 is installed such that it is penetrated into a wall or a window of a building, and includes an indoor unit 30 which is located in the building to generate a chilled air, an outdoor unit 50 which is exposed outside the building, and a partitioning plate 13 which separates the indoor unit 30 from the outdoor unit 50.

The indoor unit 30, the outdoor unit 50, and the partitioning plate 13 are located in a main chassis 12. The main chassis 12 includes a front plate 14 which is located in the front of the indoor unit 30, a rear plate 16 which is located in the front of the outdoor unit 50, side plates 18 which connect the front plate 14 to the rear plate 16, an upper plate 20, and a lower plate 22. A first air inlet 15 through which an interior air is introduced is formed in the front plate 14, and an air outlet 17 through which an air inside the outdoor unit 50 is discharged to the outside is formed in the rear plate 16, and a plurality of second air inlets 19 through which an air is introduced into the outdoor unit 50 are formed in the side plates 18.

The indoor unit 30 includes a filter 32 for filtering the air introduced into the first air inlet 15, an evaporator 36 for cooling the introduced air to generate a chilled air, a blowing fan 38 for blowing the chilled air into the building, a chilled air guide duct 40 for guiding the chilled air blown by the blowing fan 38 into the building, and a plurality of blades 42 which are installed in the guide duct 40 to change the direction of the chilled air introduced into the building.

The filter 32 is slidably supported by a support member 34 installed between the front plate 14 and the evaporator 36, and filters the dusts contained in the interior air.

The blowing fan 38 is rotatably mounted within the guide duct 40. As shown in FIG. 2, the guide duct 40 are formed with a chilled air inlet 44 through which the chilled air generated by the evaporator 36 is introduced, and a chilled air outlet 46 which discharges the chilled air blown by the blowing fan 38 into the building and in which the plurality of blades 42 are installed. The guide duct 40 has a snail-like cross section, and protects the impeller-shaped blowing fan 38.

The outdoor unit 50 includes a compressor 52 which is connected through a liquid coolant pipe (not shown) to the evaporator 36 and compresses the coolant, a condenser 54 which is connected through the coolant pipe to the compressor 52 and the evaporator 36 and condenses the coolant, a cooling fan 56 which discharges an warm air generated by the condenser 54 to the outside of the outdoor unit 50, and a motor 60 which includes a driving shaft 58 to which the blowing fan 38 and the cooling fan 56 are mounted. The driving shaft 58 of the motor 60 to which the blowing fan 38 is mounted is penetrated into the partitioning plate 13. When the motor 60 is driven, the exterior air is introduced into the outdoor unit 50 through the second air inlets 19 by the rotation of the cooling fan 56. The air introduced into the outdoor unit 50 is flowed into the condenser 54 by the cooling fan 56 and cools the condenser 54, and the warm air passing through the condenser 54 is discharged to the outside through the air outlet 17.

When a power is applied to the air conditioner 10 using an operating panel (not shown), the compressor 52 and the motor 60 are driven. A gaseous coolant of high temperature and pressure compressed by the compressor 52 is introduced from the evaporator 36 to the condenser 54.

The gaseous coolant in the condenser 54 is phase-changed to a liquid coolant of 60 through 130 degrees (°C.) and of high pressure. Then, the exterior air introduced through the second air inlets 19 is discharged to the outside through the air outlet 17 after it cools the condenser 54.

The liquid coolant which has passed through the condenser 54 is decompressed via a capillary tube (not shown) and is expanded in the evaporator 36. Then, the liquid coolant is phase-changed to the gaseous coolant of low temperature and pressure. The air introduced into the indoor unit 30 through the first air inlet 15 of the front plate 14 is filtered by the filter 32, and is heat-exchanged with the evaporator 36 to a chilled air. The chilled air is blown into the building by the blowing fan 38, and the gaseous coolant is returned to the condenser 54 by the compressor 52.

During the operation of the air conditioner 10, the coolant repeats the cooling cycle through the compressor 52, the condenser 54 and the evaporator 36.

The air flow in the air conditioner 10 affects the heat-exchange capacity and the energy efficiency ration (E.E.R) of the evaporator 36. The flow rate of the air passing through the evaporator 36, and the cross section of the evaporator 36 are proportional to the heat-exchange capacity of the evaporator 36, and the flow rate is inversely proportional to the heat-exchange capacity. In order to improve the heat-exchange capacity of the evaporator 36, the guide duct 40 of the air conditioner 10 is manufactured such that it is formed of snail-like shape. Due to the guide tube 40 of snail-like shape, the air resistance decreases and the flow rate of the air passing through the evaporator 36 increases. Therefore, the heat-exchange capacity of the evaporator 36 is improved.

However, in case that the resistance of the air flowing through the guide duct 40 decreases, the air flow rate increases and the load of the motor 60 increases. As a result, the heat-exchange capacity is hardly improved.

SUMMARY OF THE INVENTION

Therefore, it is an object of the present invention to provide an integrated air conditioner which can reduce the load of the motor, thereby improving the heat-exchange capacity and the energy consumption efficiency of the evaporator.

In order to accomplish the above-mentioned object of the present invention, the integrated air conditioner according to the present invention comprises:

an indoor unit located in a building and including an evaporator for generating a chilled air, a blowing fan for blowing the chilled air into the building, and a chilled air guide duct to which the blowing fan is rotatably mounted, and in which a chilled air inlet through which the chilled air is introduced and a chilled air outlet through which the chilled air blown by the blowing fan is discharged is formed, for guiding the chilled air into the building;

an outdoor unit including a compressor connected to the evaporator for compressing a coolant, a condenser connected to the compressor and the evaporator for condensing the coolant, a cooling fan for discharging a warm air generated by the condenser, and a motor having a driving shaft to which the blowing fan and the cooling fan are mounted; and a flow rate control section installed in the indoor unit for controlling an amount of the chilled air blown by the blowing fan.

The flow rate control section has a first inclined surface formed toward the inlet of the chilled air guide duct and having a first inclined angle; a second inclined surface formed toward the outlet of the chilled air guide duct and having a second inclined angle; and an upper surface connecting the first and second inclined surfaces, and is installed on both sidewalls of the chilled air guide duct. The flow rate control section is a boss, and an absolute value of the first inclined angle is greater than that of the second inclined angle.

A resistance is exerted on the chilled air blown by the blowing fan into the building by the existence of the flow rate control section to decrease the flow velocity and flow rate of the chilled air. Therefore, the load of the motor which drives the blowing fan decreases and the number of revolution of the motor increases. As a result, the heat-exchange capacity of the evaporator is improved.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE PREFERRED EMBODIMENT

Hereinafter, a preferred embodiment of the present invention will be explained in more detail with reference to the accompanying drawings.

Figure 1:
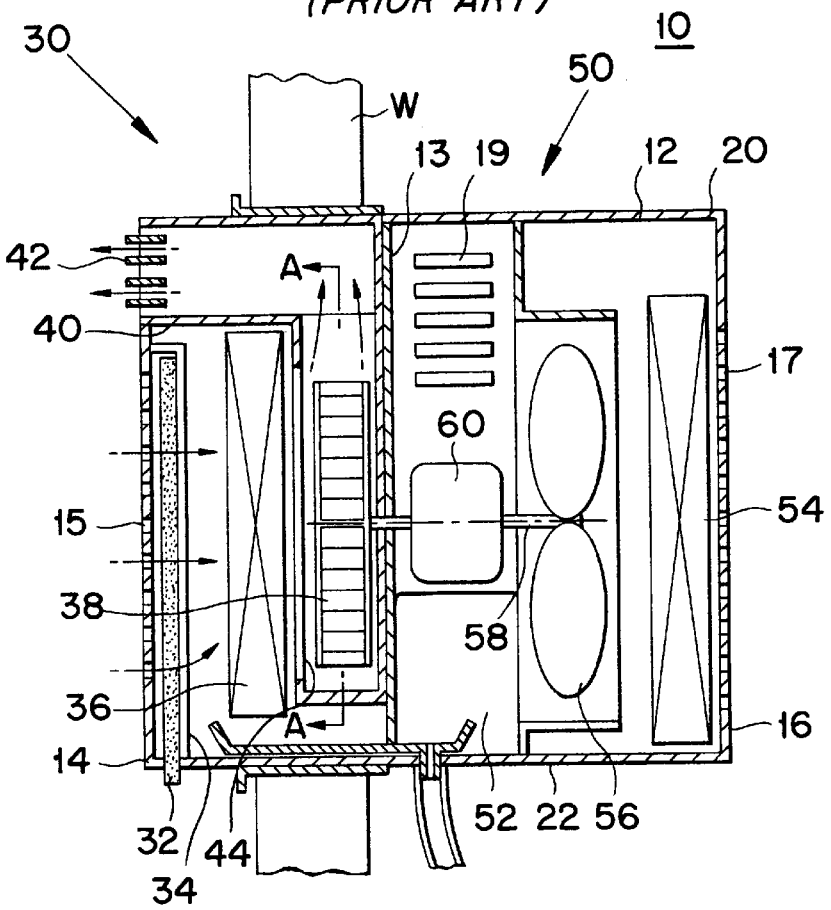
FIG. 1 (PRIOR ART)
FIG. 1 is a sectional view for showing a conventional integrated air conditioner.
Figure 2:
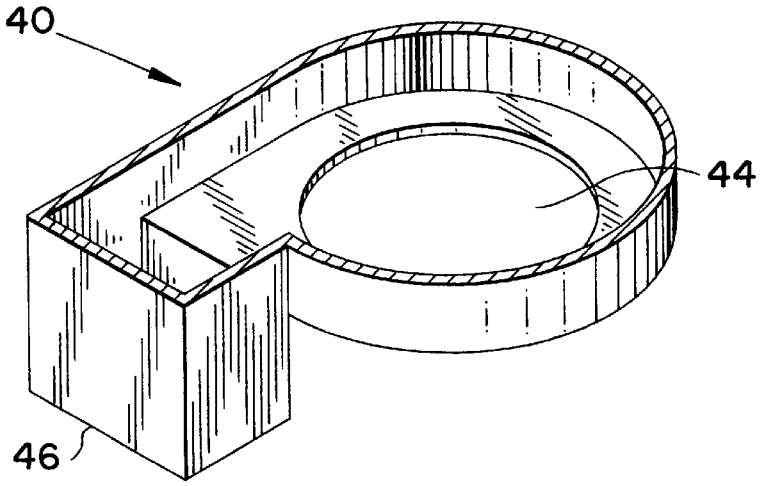
FIG. 2 (PRIOR ART)
FIG. 2 is a cut-away perspective view taken along line A—A of a guide duct of FIG. 1.
Figure 3:
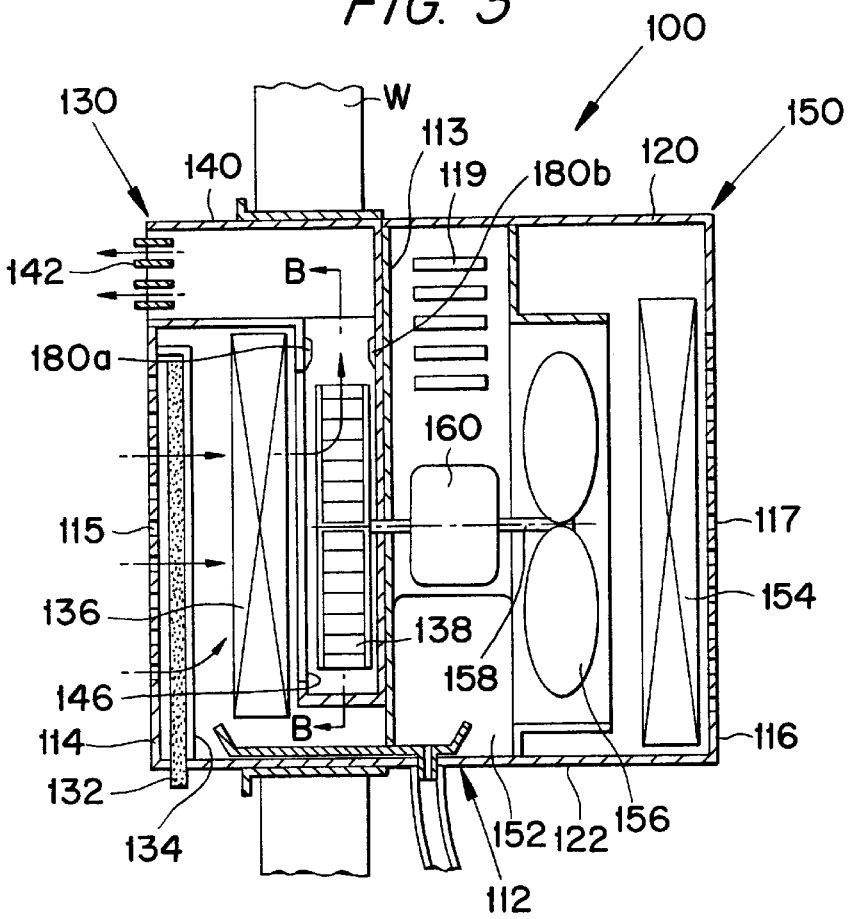
FIG. 3 is a sectional view for showing an integrated air conditioner according to a preferred embodiment of the present invention.

FIG. 3 shows an integrated air conditioner 100 according to a preferred embodiment of the present invention. As shown in FIG. 3, the air conditioner 100 includes an indoor unit 130 which is located in the building to generate a chilled air, an outdoor unit 150 which is exposed to the outside of the building, and a partitioning plate 113 which separates the indoor unit 130 from the outdoor unit 150. The air conditioner 100 is penetrated into a wall or a window W of the building.

The indoor unit 130, the outdoor unit 150, and the partitioning plate 113 are located within a main chassis 112. The main chassis 112 includes a front plate 114 which is located in the front of the indoor unit 130, a rear plate 116 which is located in the front of the outdoor unit 150, side plates 118 which connect the front plate 114 to the rear plate 116, an upper plate 120, and a lower plate 122. A first air inlet 115 through which an interior air is introduced is formed in the front plate 114, and an air outlet 117 through which an air inside the outdoor unit 150 is discharged to the outside is formed in the rear plate 116, and second air inlets 119 through which an air is introduced into the outdoor unit 150 are formed in the side plates 118.

The indoor unit 130 includes a filter 132 for filtering the air introduced through the first air inlet 115, an evaporator 136 for cooling the introduced air to generate a chilled air, a blowing fan 138 for blowing the chilled air into the building, a chilled air guide duct 140 for guiding the chilled air blown by the blowing fan 138 into the building, and a plurality of blades 142 which is installed in the chilled air guide duct 140 to change the direction of the chilled air introduced into the building.

The filter 132 is slidably supported by a support member 134 located between the front plate 114 and the evaporator 136, and filters the dusts contained in the interior air.

The blowing fan 138 is rotatably mounted within the guide duct 140. As shown in FIG. 3, the guide duct 140 is formed with an inlet section 144 having a chilled air inlet 146 through which the chilled air generated by the evaporator 136 is introduced, and a chilled air outlet 148 which discharges the chilled air blown by the blowing fan 138 into the building and in which the plurality of blades 142 are installed. The guide duct 140 has a snail-like cross section and prevents the impeller-shaped blowing fan 138 from being damaged. A flow rate control section for controlling flow rate of the chilled air blown by the blowing fan 138 is located on the inner wall of the inlet section 144.

Figure 4:
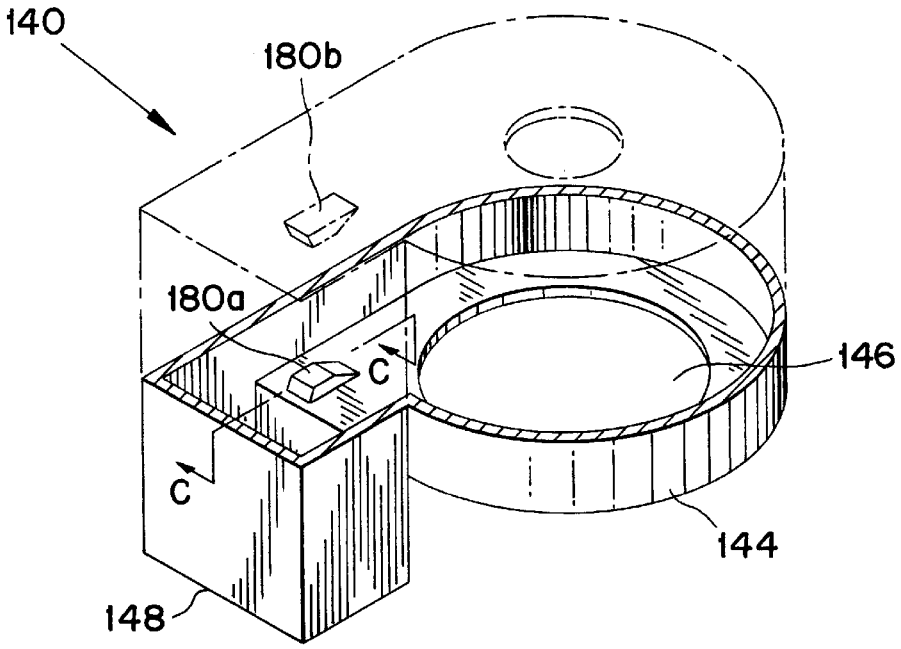
FIG. 4 is a cut-away perspective view taken along line B—B of a guide duct of FIG. 3.
Figure 5:
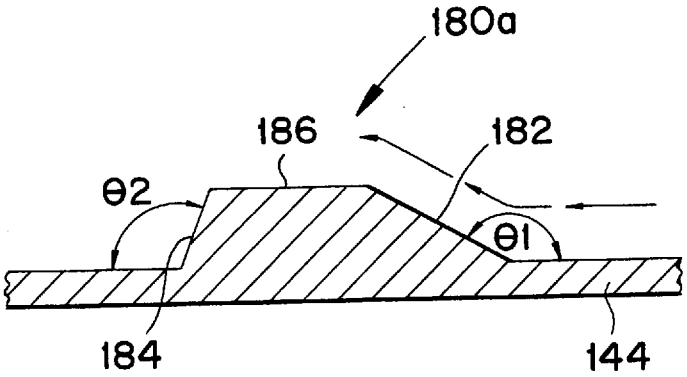
FIG. 5 is a sectional view taken along line C—C of FIG. 4.
Figure 5A:
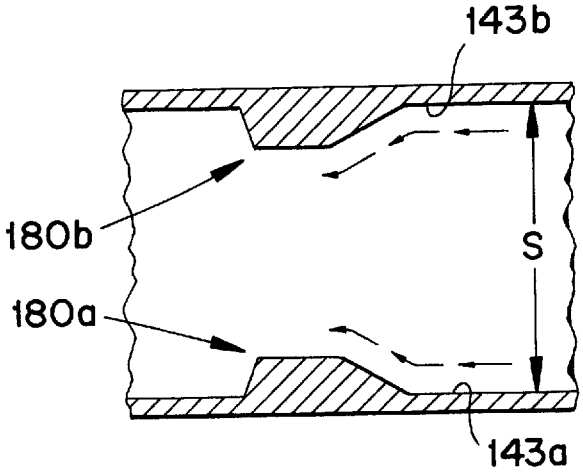
FIG. 5A is an enlarged fragmentary view of FIG. 3.

The flow rate control section, as shown in FIGS. 4–5 and 5A, comprises a pair of bosses 180*a*, 180*b* situated directly opposite one another on respective mutually facing inner wall surfaces 143*a*, 143*b* of the guide duct 140. The bosses can be formed integrally with the guide duct 140 or can be manufactured separately from the guide duct 140 and attached to the inner wall surfaces of the guide duct 140.

Each boss has a first inclined surface 182 facing upstream toward the chilled air blown by the blowing fan 138, a second inclined surface 184 which faces downstream, and an upper surface 186 which interconnects the first and second inclined surfaces 182 and 184. The first and second inclined surfaces 182 and 184 are respectively inclined by first and second inclined angles θ1 and θ2 with respect to the inner wall surface of the inlet section 144. The absolute value of the first inclined angle θ1 is greater than that of the second inclined angle θ2. Therefore, the flow cross sections of the chilled air blown by the blowing fan 138 is caused to gradually decrease by the first inclined surfaces 182 of the bosses 180*a*, 180*b*, and is constant along the upper surfaces 186, and abruptly increases on the second inclined surfaces 184 and thus reassumes the original flow cross section.

Figure 6:
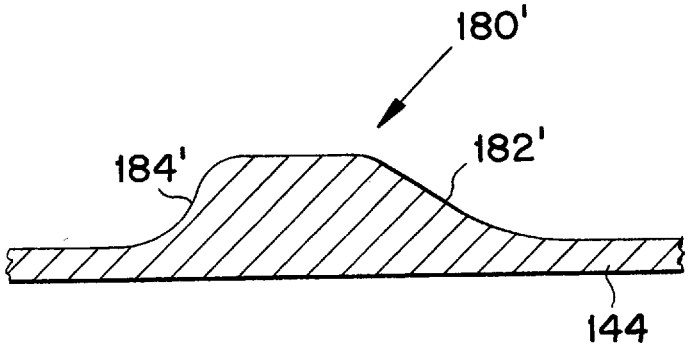
FIG. 6 is a view similar to FIG. 5 of another embodiment of the invention.

According to the present invention, the first and second inclined surfaces 182 and 184 are formed to be linear. However, as shown in FIG. 6, the first and second inclined surfaces 182' and 184' may be formed to be curved. At this time, the radius of curvature of the first inclined surface 182' is larger than that of the second inclined surface 184'.

The outdoor unit 150 includes a compressor 152 which is connected through a liquid coolant pipe (not shown) to the evaporator 136 and compresses the coolant, a condenser 154 which is connected through the coolant pipe to the compressor 152 and the evaporator 136 and condenses the coolant, a cooling fan 156 which discharges an warm air generated by the condenser 154 to the outside of the outdoor unit 150, and a motor 160 having a driving shaft 158 to which the blowing fan 138 and the cooling fan 156 are mounted. The driving shaft 158 to which the blowing fan 138 is mounted is penetrated into the partitioning plate 113. When the motor 160 is driven, the exterior air is introduced through the second air inlet 119 into the outdoor unit 150 by the rotation of the cooling fan 156. The air introduced into the outdoor unit 150 is flowed into the condenser 154 by the cooling fan 156 and cools the condenser 154, and the warm air passing through the condenser 154 is discharged through the air outlet 117 to the outside.

Hereinafter, the operation of the integrated air conditioner 100 according to the preferred embodiment of the present invention will be described in detail.

When a power is applied to the air conditioner 100, the compressor 152 and the motor 160 are driven, and then the evaporator 136 generates a chilled air and the condenser 154 generates a warm air. The warm air is discharged to the outside of the outdoor unit 150 by the cooling fan 156, and the chilled air is discharged to the outside of the indoor unit 130 by the blowing fan 138.

The chilled air generated in the evaporator 136 is introduced into the chilled air guide duct 140 through the inlet 146. The chilled air blown by the blowing fan 138 flows at a constant velocity through the cross section formed by the inner wall of the chilled air guide duct 140. When the chilled air reaches the first inclined surfaces 182 of the flow rate control section, the cross section decreases so that a resistance is applied to the chilled air by the existence of the first inclined surfaces 182 to decrease the flow rate of the chilled air. So, the load of the motor 160 decreases, and the number of revolution (rpm) of the motor 160 increases.

The increase in the number of revolution of the motor 160 results in an increase of the flow rate of the air passing through the condenser 154. Therefore, the temperature of the condenser 154 is lowered to improve the heat-exchange capacity of the condenser 154, and thus the temperature of the evaporator 136 is lowered to improve the heat-exchange capacity of the evaporator 136.

Table. 1 is an experimental result which illustrates capacities of the conventional air conditioner and the air conditioner according to the present invention. In the experiment, the chilled air guide duct 40 of the conventional air conditioner and the chilled air guide duct 140 according to the preferred embodiment of the present invention are used.

CONDITIONS

POWER SOURCE: 60 Hz, 1 phase, 220V

SETTING VALUE OF HEAT EXCHANGE CAPACITY (Q Set): 3550 Kcal/h

SETTING VALUE OF POWER (W Set): 1400 W

TABLE 1

| | THE CONVENTIONAL | THE PRESENT INVENTION |
|---|---|---|
| HEAT EXCHANGE CAPACITY (Kcal/h) | 3475 (97.90%) | 3557 (100.19%) |
| CONSUMPTION OF POWER (W) | 1399 | 1410 |
| E.E.R | 2.484 Kcal/hW | 2.523 Kcal/W |
| REVOLUTION (RPM) | 880 | 925 |

As shown in Table. 1, as compared with in the conventional integrated air conditioner, the integrated air conditioner according to the present invention increases by 2.2% in the heat exchange capacity and by 0.04 Kcal/hW in the E.E.R.

As above-described, in the integrated air conditioner according to the present invention, the load of the motor decreases, the number of revolution of the motor increases, the heat-exchange capacity of the evaporator increases, and thereby the energy consumption efficiency is improved.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. An integrated air conditioner comprising:

an indoor unit located in a building and including an evaporator for generating chilled air, an air guide duct, a blowing fan for blowing the chilled air through the air guide duct in a downstream direction, the air guide duct including a chilled air inlet through which the chilled air is introduced and a chilled air outlet through which the chilled air is discharged into the building;

an outdoor unit including a compressor connected to the evaporator for compressing a coolant, a condenser connected to the compressor and the evaporator for condensing the coolant, a cooling fan for discharging a warm air generated by the condenser to the outside, and a motor having a driving shaft to which the blowing fan and the cooling fan are mounted; and flow rate control apparatus installed in the indoor unit, for controlling an amount of the chilled air blown by the blowing fan, the flow rate control apparatus comprising bosses situated directly opposite one another on respective mutually facing surfaces of the air guide duct, each boss including an inclined first surface facing upstream, and an inclined second surface facing downstream, the inclined first surfaces together defining a gradually diminishing cross section of the air guide duct in the downstream direction, and the inclined second surfaces together defining a gradually expanding cross section of the duct in the downstream direction.

2. The integrated air conditioner according to claim 1 wherein each of the inclined first surfaces forms a first angle with the respective duct surface, and each of the inclined second surfaces forms a second angle with the respective duct surface, the first angle being larger than the second angle.

3. The integrated air conditioner according to claim 1 wherein each of the inclined first and second surfaces are curved.

4. The integrated air conditioner according to claim 3 wherein a radius of curvature of the inclined first surfaces is greater than a radius of curvature of the inclined second surfaces.

* * * * *